US005217133A

United States Patent [19]

Timson et al.

[11] Patent Number: 5,217,133

[45] Date of Patent: Jun. 8, 1993

[54] CAN CONSTRUCTION WITH WALL INDENTATION

[75] Inventors: William J. Timson, Pocasset; Paul R. Chalifoux, Wellesley, both of Mass.

[73] Assignee: Wellesley Research Associates, Inc., Wellesley, Mass.

[21] Appl. No.: 887,878

[22] Filed: May 26, 1992

Related U.S. Application Data

[63] Continuation-in-part of Ser. No. 722,525, Jun. 27, 1991, which is a continuation-in-part of Ser. No. 606,564, Oct. 31, 1990, Pat. No. 5,027,968.

[51] Int. Cl.[5] ..... B54D 17/00

[52] U.S. Cl. ..... 220/260; 220/269; 220/277

[58] Field of Search ..... 220/269, 270, 265, 266, 220/670, 672, 669, 260, 277

[56] References Cited

U.S. PATENT DOCUMENTS

| | | | |
|---|---|---|---|
| 3,494,500 | 2/1970 | Foster | 220/269 |
| 4,171,062 | 10/1979 | Allen et al. | 220/270 |
| 4,332,332 | 6/1982 | Ingemann | 220/270 X |
| 5,027,968 | 7/1991 | Timson | 220/269 |
| 5,143,240 | 9/1992 | Timson | 220/269 X |

*Primary Examiner*—Steven M. Pollard
*Attorney, Agent, or Firm*—Paul J. Cook

[57] ABSTRACT

A container is provided with a top to which is secured at least one strip. The strip or strips can be free of prestress bias or are provided with a prestress bias so that when the top is severed from the container, the strip or strips are lifted away from the top so that the strip can be grasped easily to provide a means for lifting the top away from the container. An indentation is provided in the container wall to prevent a severed container top from sinking into the contents of the container.

24 Claims, 7 Drawing Sheets

CAN CONSTRUCTION WITH WALL INDENTATION

REFERENCE TO RELATED APPLICATION

This application is continuation-in-part of copending application Ser. No. 722,525, filed Jun. 27, 1991, which, in turn is a continuation-in-part of application Ser. No. 606,564, filed Oct. 31, 1990, now U.S. Pat. Nos. 5,027,968.

BACKGROUND OF THE INVENTION

This invention relates to a container construction comprising a container having a sealed cover which can be manually removed from said container when the cover is severed from the container and wherein movement of a severed cover is limited by the can wall construction. More particularly, this invention comprises a container construction for a liquid having a cover which includes strip means which promotes ease of manual removal of the cover from the container when the cover is severed from the container and which prevents a severed cover from sinking into the contents of the container.

Prior to the present invention, containers such as metallic or plastic containers have been provided with a cover which can be opened by hand. These containers included the construction having a "pop-top" opener handle which is formed integrally with the cover and can be lifted by hand to form an opening in the cover which is defined by a previously molded indentation in the cover. These containers have been designed either to form a centrally located opening in the cover such as is common in a beverage container or can be found to extend about the cover periphery to remove the cover, as is common in processed foods such as cheese products. The opener handles which form a central opening are not useful when the container contains a liquid food product since a portion of the outside surface of the opened handle extends into the liquid and can contaminate the liquid. The handle openings which permit removal of the entire cover are expensive.

Even with containers having a top with a strip as disclosed in U.S. Pat. No. 5,027,968 can be of limited use since the user may be too slow in grasping a free end of a severed strip before a severed cover sinks into a liquid housed within a container.

It has also been proposed in U.S. Pat. No. 2,637,465 to provide a handle which can be bent away from a can top so that the can top can be subsequently lifted away from the can after the top has been cut. This handle means is undesirable since force is required to bend it away from the can which force would force the contents onto the top after it is cut. In addition, it is expensive to produce.

It would be desirable to provide a container construction which includes a cover which can be easily manually removed from the container when the cover is severed and wherein movement of a severed cover is limited without interfering with the container's contents such as undesirably would be the case when the cover sinks into the container housing a liquid products such as a soup.

SUMMARY OF THE INVENTION

The present invention provides a container construction with a top having a handle in the form of a tab, a strip or a plurality of strips which can be exposed or covered by a severable cover. The strips can be prestressed and secured to the container in a manner such that when the container top and, when present, a cover are cut about their periphery when opening the container, the strip or strips, under the prestressing forces, lift away from the container top and extend over the container rim to a position where they can be easily grasped. Alternatively, the tap or handle need not be prestressed. The walls of the container adjacent to the top are modified to include an indentation extending about all or part of the container periphery. The indentation extends into the container a small distance so that it presents a surface or surfaces within the container having an effective diameter smaller than the top diameter. The indentation prevents the severed top from sinking into the container. The cover for the top, when used can enclose the entire top to protect the can top from dust and soil or or enclose only a portion of the top which includes the strips. By extending the strips over the container rim, they can be manually grasped while avoiding exerting downward force on the opened container top. The requirement of manual force to lift the strips away from the container is eliminated so the container contents are not disturbed when the top is removed from the container. The strips are adhered to a portion of the exposed top surface while an end of each strip is rendered free from the surface when the top and cover are cut so that it can be manually grasped after the top is cut away from the container body.

DESCRIPTION OF SPECIFIC EMBODIMENTS

Figure 1:
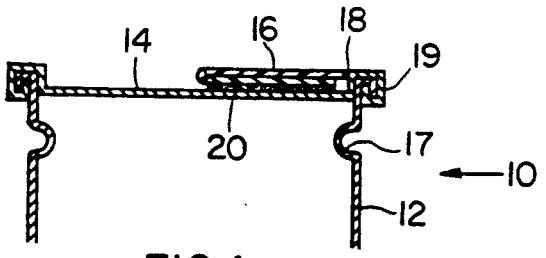
FIG. 1 is a cut-away view of a container top with a strip adhered to the top periphery.

By the term "strip" as used herein is meant an element having a flat surface such as a portion of a sheet or foam material or a curved surface such as filament which has a length such that it can be grasped manually. The strip is formed of a material which is elastic and can be prestressed so that when it is released from the forces which cause it to remain stationary, it moves, under the prestressing forces, away from the container top and over the container rim. For example, the strip can be formed of a polymeric composition such as a rubber, a solid, or a plastic foam composition, from a metallic composition, or from plastic composite materials such as plastic-graphite, plastic-metal, plastic glass, etc.

The container top of this invention includes one or more strips, usually a plurality of strips which are secured, at one end thereof to a central portion of the top or to a cover which extends over the strip and the top and the second end therof being free. The cover is secured near the top periphery so that it can be cut with the cutting tool used to open the container. Since the first strip is prestressed and the first end of the strip is secured to a central portion of the top or to the cover, when the cover is cut, the strip extends over the container rim due to the prestressed bias previously imposed into the strip. It is to be understood that any means for inducing the prestressed bias into the strip can be utilized in the present invention including natural elasticity of the material, prebending, molding and thermal preforming. In any event, the means for adhering the strip and cover is positioned on the top surface so that a strip can extend over the container rim so that it can be easily grasped when it is desired to remove the can top from the can body. The cross patch which has the permanent adhesive maintains the strip on the can top.

In an optional embodiments of this invention, a cover for the strip or strips can be utilized to maintain the top of the container clean.

To obtain a length-stable bottom layer of the cover, the bottom layer can be made of a suitable metal, such as stainless steel, aluminum, iron, copper alloys or a suitable dimensionally stable plastic, such as polysulfone, polycarbonate, polyimide, polyethermide or polyester. The upper layer can be formed of a shrinkable polymer that shrinks to a desired amount to give the desired pre-stressed curl to the cover such as heat treatment, including polyolefins such as polyethylene or polypropylene, polyethylene vinyl acetate and other copolymers, polystyrene- butadiene, polyvinylidene chloride. The bottom and top layers of the covers can be co-extruded and can be laminated. Alternatively, fibers, of lower and higher thermal shrinking can be sandwiched to a polymer strip to provide the desired cover bending.

Stressing of can tabs also can be achieved by differential contraction of a bi-compositional strip which has more shrinkage on the upper layer than on the bottom layer when the cover is heated during steam sterilization or other heat application. Multilayered strip compositions utilizing this feature also can be used. Alternatively, a sheet of a single polymeric composition can be shrunk on the upper surface by a rapid heat pulse such shrinkage on one surface of the strip to provide desired prestressing for sheet curling.

Curling of the cover, causing the cover to bias away from the can top, allows one to also easily grasp the cover sheet so that the can top can be easily lifted manually away from the container body by either the cover sheet or the strip. The body of the container includes one or more indentations formed into the container wall and positioned adjacent to the cover top when the top is in its sealed position. The indentation or indentations are of a size and are positioned to prevent the severed top from sinking into the container contents so that the severed cover can be easily retrieved by means of the cover or the strips. Thus, the indentations function, in conjunction with the cover or the strips to provide a means to easily retrieve the severed top. Generally, the indentations are positioned into the container walls a distance between about 1 and 10 mm from the top and indent from the container wall a distance between about 1 and 10 mm. The indentation can be made easily during formation of the container walls.

The strip is prestressed so that when the can top 14 is cut about its periphery 15 and the adhesive 18 is severed, the strip 16 is biased away from the top 14 to extend above the container rim 19 and can easily be grasped.

The strip can be placed on the can in any desired direction, that is radially pointing outward, inward or tangentially. When the strips are sufficiently flexible and hold their set prestressed shape well, they can be handled, stacked, stored and passed through a can opening process without difficulty. The can top strips can be applied at any convenient time before, during or after canning such as before or after labeling.

Figure 2:
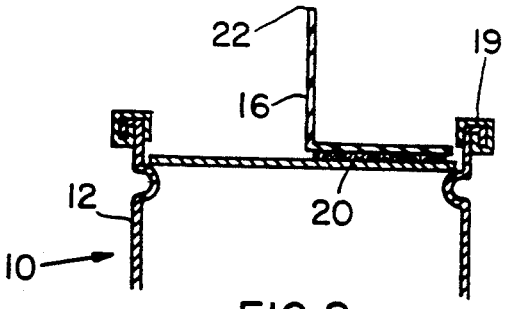
FIG. 2 is a cut-away view of a container top of FIG. 1 after the strip and top have been severed.
Figure 5A:
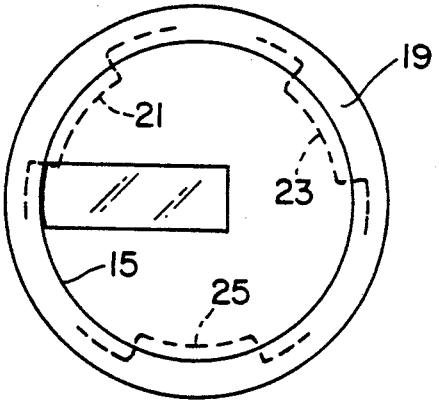
FIG. 5 is a top view of an alternative indentation arrangement for the container of FIG. 3.
Figure 5:
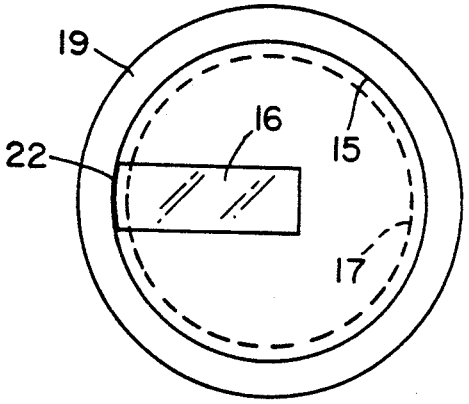

Referring to FIGS. 1, 2 and 5, the container 10 of this invention includes a container body 12, a sealed top 14 and a strip 16. Strip 16 is secured to top 14 such as with an adhesive 20 and to the rim 19 with adhesive 18. The strip 16 is prestressed so that when it is cut at its end 22 where it is adhered with adhesive 18, when the can top 14 is cut about its periphery 15, the strip 16 is biased away from the top 14 to extend above the container rim 19 and can be easily grasped. The indentation 17 is positioned near the top 14 so that when the top 15 is severed, the indentation prevents the top from sinking into the liquid contents of the can. The top 14 can be easily lifted manually away from the container body 12 by gripping the free end of a strip 16.

An alternative indentation arrangement is shown in FIG. 5*a* wherein a plurality of indentation segments 21, 23 and 25 are utilized rather than a continuous indentation 17.

Figure 3:
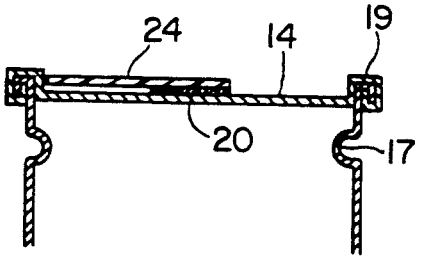
FIG. 3 is a cut-away view of an alternatiave container top with an unfolded strip adhered to the top periphery.
Figure 4:
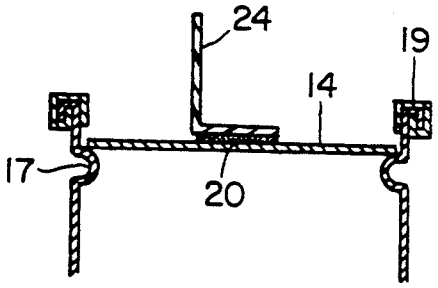
FIG. 4 is a cut away view of a container top of FIG. 3 after the strip and top have been cut.

As shown in FIGS. 3 and 4, the strips 24 can be adhered to the top 14 and rim 19 in an unfolded position. The strip 24 is prestressed to assume the position shown in FIG. 4 after being severed.

Figure 6:
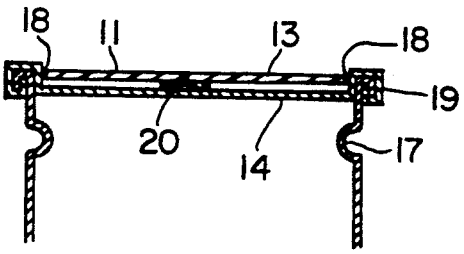
FIG. 6 is a cut away view of a container with two strips adhered to a cover.
Figure 7:
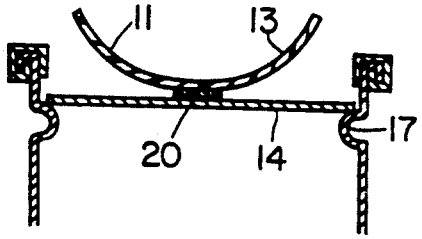
FIG. 7 shows the container of FIG. 6 after the strips and top have been cut.

In an alternative construction as shown in FIGS. 6 and 7, two strips 11 and 13 are each adhered to the top 14 by an adhesive or solder 20 and to the rim 19 by adhesive 18. When the can top 14 is cut, the strips 11 and 13 assume the configuration shown in FIG. 7 and the top 14 is retained by indentation 17.

Figure 8:
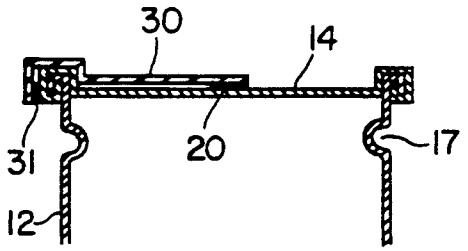
FIG. 8 shows an alternative form of this invention with one strip secured with an adhesive to the cover and the side of the container.
Figure 9:
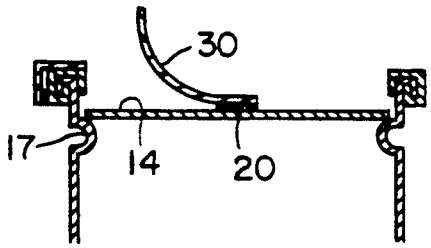
FIG. 9 shows the container top of FIG. 8 after the strip and top have been cut.
Figure 10:
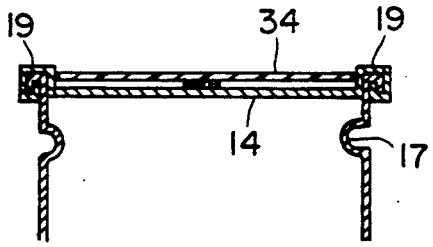
FIG. 10 is a cut-away view of a container with a prestressed cover.

An alternative strip design is shown in FIGS. 8 and 9 where strip 30 is adhered to top 14 and to the outside of the container 12 by adhesives 20 and 31. When the top 14 is cut, the strip 30 assumes the position shown in FIG. 9 so that it can be grasped. The top is retained by indentation 17.

Figure 11:
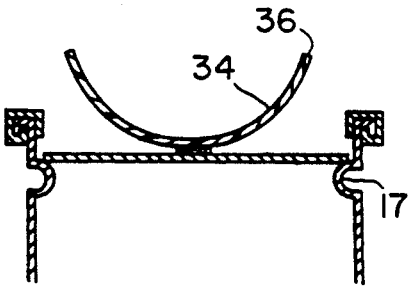
FIG. 11 is the container of FIG. 10 after the cover and top have been cut.
Figure 12:
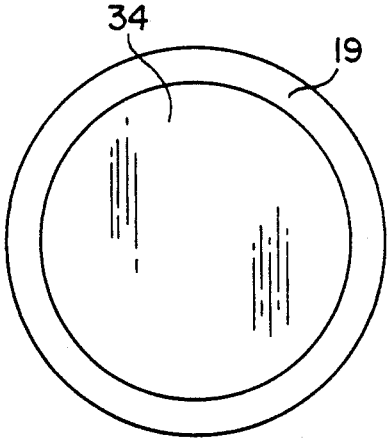
FIG. 12 is a top view of the container of FIG. 10.
Figure 13:
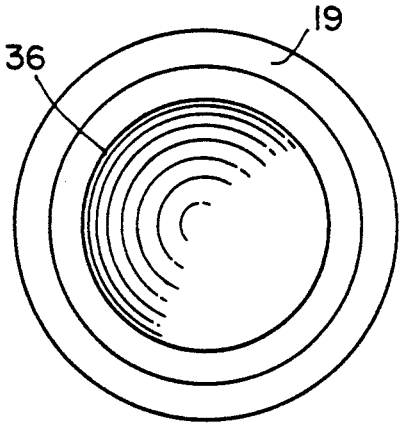
FIG. 13 is a top view of the container of FIG. 11.

As shown in FIGS. 10, 11,12 and 13, a cover 34 covers the top 14 and is adhered to the rim 19 and to the top 14 by adhesive 18 and 20. When the cover 34 and top 14 are severed, the free ends perimeter 36 extends upwardly as shown in FIGS. 11 and 13 to be grasped while top 14 is retained by indentations 17.

Figure 14:
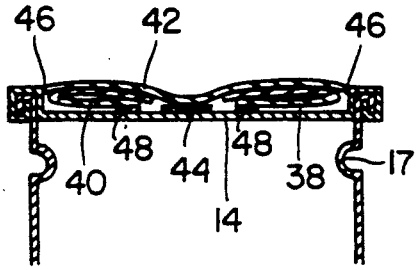
FIG. 14 shows a container of this invention with a cover and with strips that can extend over the container rim when cut.
Figure 15:
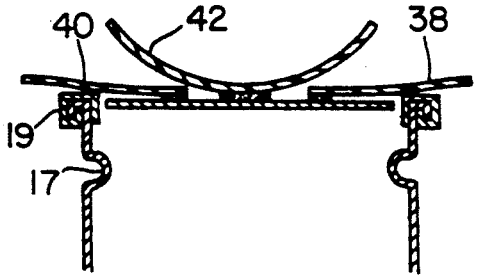
FIG. 15 is the container of FIG. 14 after the top and cover have been cut.

As shown in FIGS. 14 and 15, the strips 38 and 40 and cover 42 may be adhered with adhesive 44, 46 and 48 respectively, to can top 14. When the cover 42 is severed, the strips 38 and cover 42 extend upwardly as shown in FIG. 15.

Figure 16:
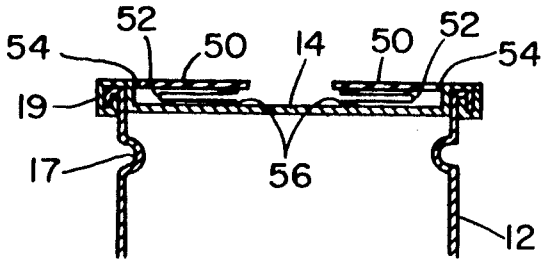
FIG. 16 shows a container of this invention with two strips that can extend over the rim after being severed.
Figure 17:
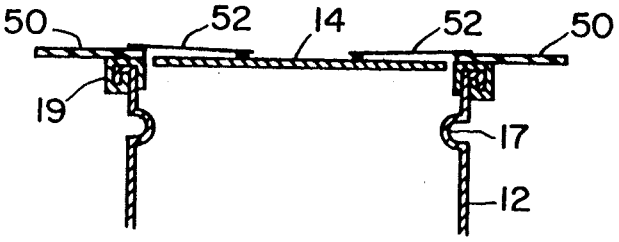
FIG. 17 shows the container of FIG. 16 after the top and strips are cut.

As shown in FIGS. 16 and 17, the strip can include a stiff section 50 and a flexible section 52. The stiff section 50 is adhered to the rim 19 with adhesive 54 and the flexible section is adhered to top 14 with adhesive 56. The strip section 50 and 52 assume the position shown in FIG. 17 when adhesive 54 is cut. The indentation 17 prevents the top 14 from sinking into the container 12.

Figure 18:
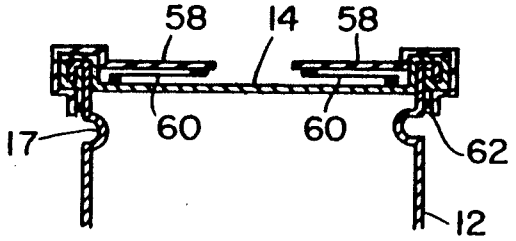
FIG. 18 is a cut-away view of a container with two strips.
Figure 19:
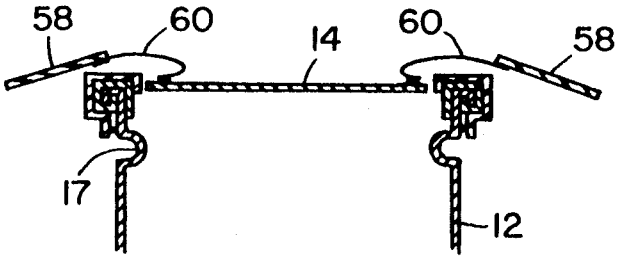
FIG. 19 is a cut-away view of the container of FIG. 18 after the top and strips are severed.

An alternate strip design is shown in FIGS. 18 and 19 where a strip includes a stiff section 58 and a flexible section 60. Stiff section 58 is adhered to the outside wall 62. When the stiff section 60 and top 14 are cut, the strips assume the position shown in FIG. 19. The indentation 17 prevents the top 14 from sinking into container 12.

Figure 20:
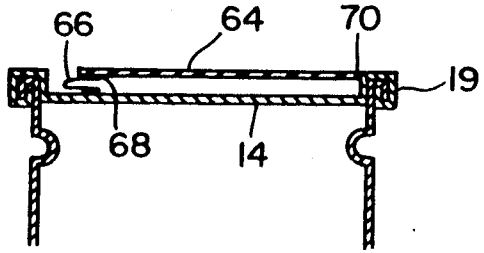
FIG. 20 is a cut-away view of a container having a strip extending across the top of the container.
Figure 21:
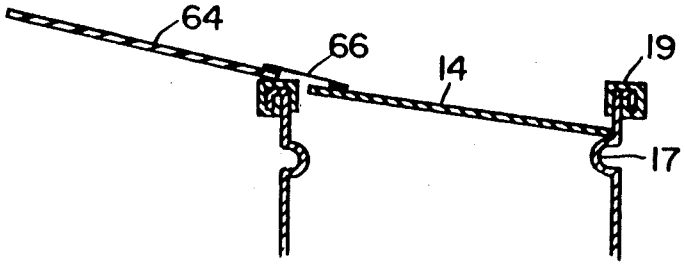
FIG. 21 is a cut-away view of the container of FIG. 20 after the top and strip are severed.

Referring to FIGS. 20 and 21, a strip is utilized having a stiff section 64 and a prestressed flexible section 66 adhered to the stiff section 64 with adhesive 68. The stiff section 64 is adhered to rim 19 with adhesive 70. Flexible section 66 is adhered to top 14 with adhesive 72. When adhesive 70 and top 14 are severed, the sections 64 and 66 and top 14 assume the position shown in FIG. 21. Indentation 17 retains severed top 14.

Figure 22:
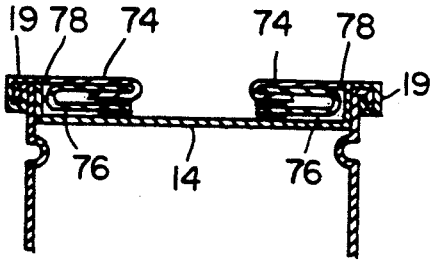
FIG. 22 is a cut-away view of a container having strips formed of two sections.
Figure 23:
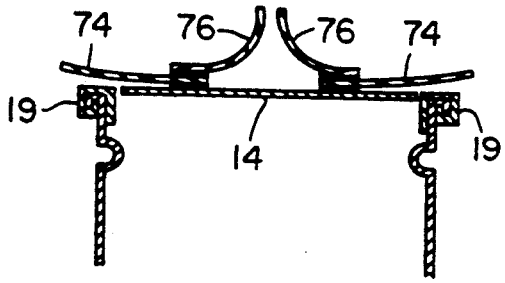
FIG. 23 is a cut-away view of the container of FIG. 22 after the top and strips are severed.

As shown in FIGS. 22 and 23, the strips also can be formed of two flexible prestressed sections 74 and 76. Section 76 is joined to section 74 and to top 14. Section 74 is joined at its second end to rim 19. Section 76 is adhered at is second end to top 14. When adhesive 78 is severed, the strip sections 74 and 76 assume the position shown in FIG. 23.

Figure 24:
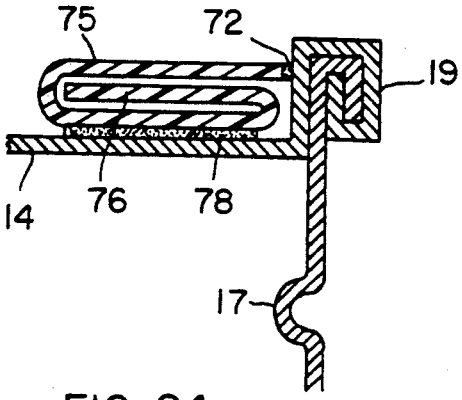
FIG. 24 is a cut-away view of a container having a strip with two free ends.
Figure 25:
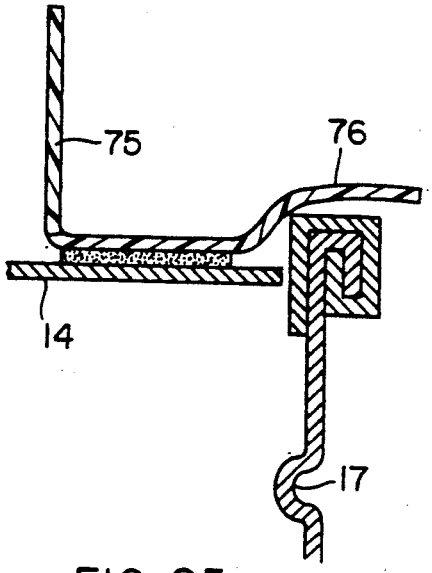
FIG. 25 is a cut-away view of a container of FIG. 23 after the top and strip is severed.

As shown in FIGS. 24 and 25, a strip can also be formed with two prestressed legs 75 and 76, folded over each other. Leg 75 is joined with adhesive 77 to rim 19. The middle of the strip is adhered with adhesive 78 to the top 14. When adhesive 77 is severed, the strip legs 75 and 76 assume the positions shown in FIG. 25.

Figure 26:
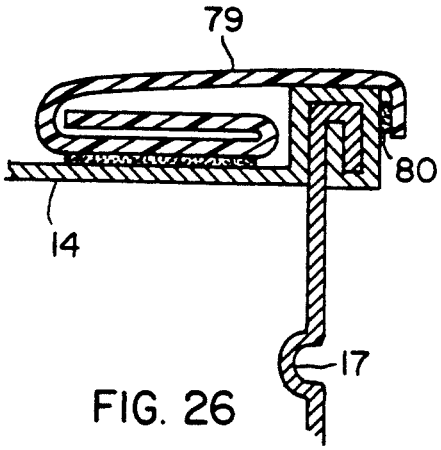
FIG. 26 is a cut-away view of a container with a strip adhered to the container rim.
Figure 27:
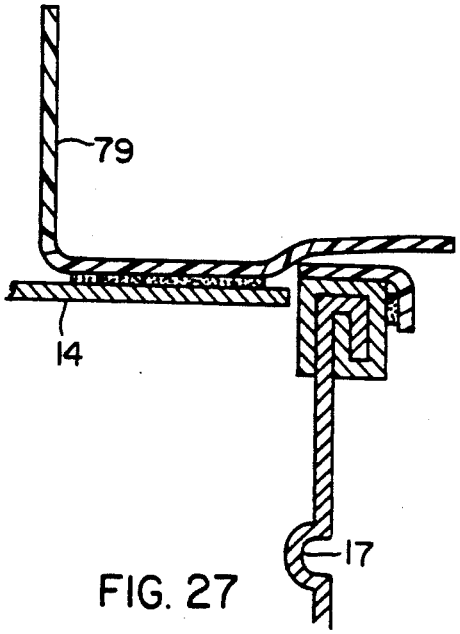
FIG. 27 is a cut-away view of the container of FIG. 26 after the top and strip is severed.

FIGS. 26 and 27 show an alternate form of this invention with the leg 79 secured with adhesive 80 to the side of the container 12. In each case indentation 17 prevents the top 14 from sinking into the container 12.

Figure 28:
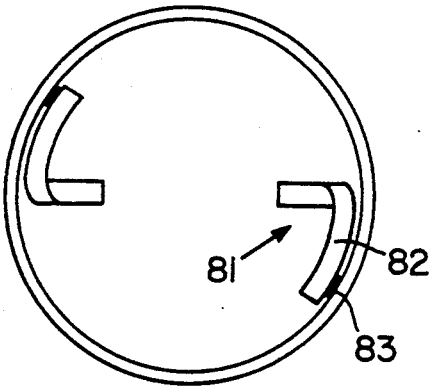
FIG. 28 is a top view of a container having bent strips.
Figure 29:
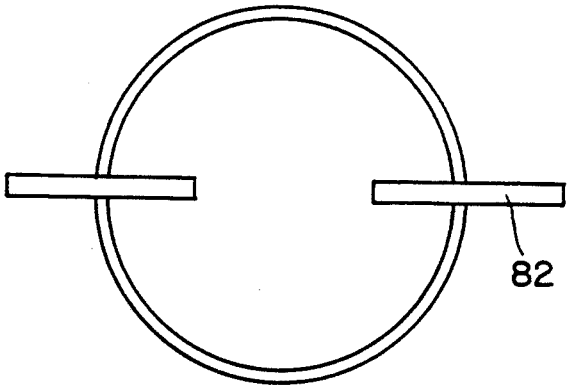
FIG. 29 is a top view of the container of FIG. 28 after the top and strips are severed.
Figure 30:
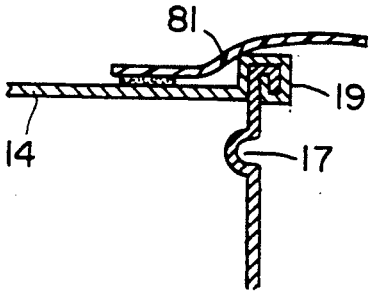
FIG. 30 is a cut-away view of the container of FIG. 29.

An alternate design is shown in FIGS. 28, 29, and 30 where one end of the strip 81 is adhered to top 14 and the other end 82 folded along the rim 19 and adhered to the rim 19 by adhesive 83.

When the can top 14 is cut about its periphery strip 82 is biased away from the top 14 to extend above the container rim 19 and can easily be grasped.

Figure 31:
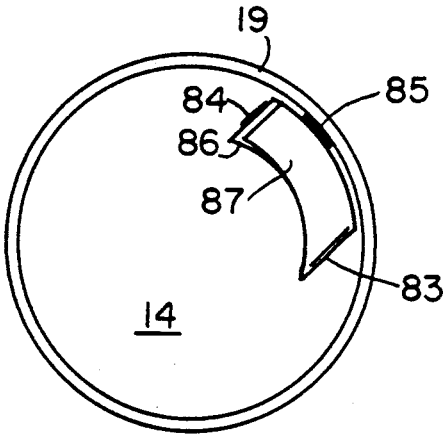
FIG. 31 is a top view of a container with a bent strip.
Figure 32:
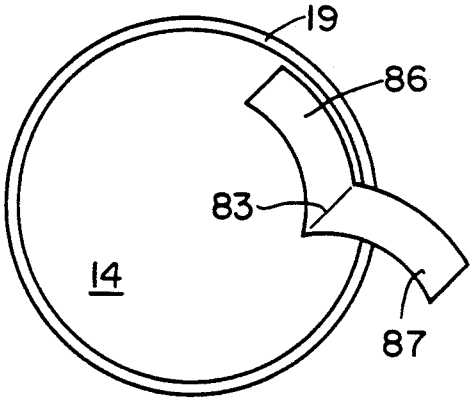
FIG. 32 is a top view of the container of FIG. 33 after the top and strip are severed.
Figure 33:
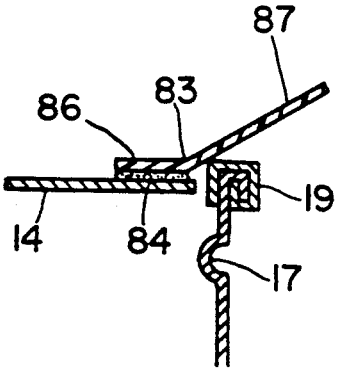
FIG. 33 is a cut-away view of the container of FIG. 32.

FIGS. 31, 32, and 33 show a strip with a prestressed hinge section 83 at an angle in the middle of the strip. One end 86 is adhered with adhesive 84 to top 14. The other end 87 is adhered to the rim 19 with adhesive 85.

When adhesive 85 is severed the strip end 87 assumes the position shown in FIG. 32.

End sections 86 and 87 may be stiff whereas the prestressed hinge section 83 is elastic or a spring.

Figure 34:
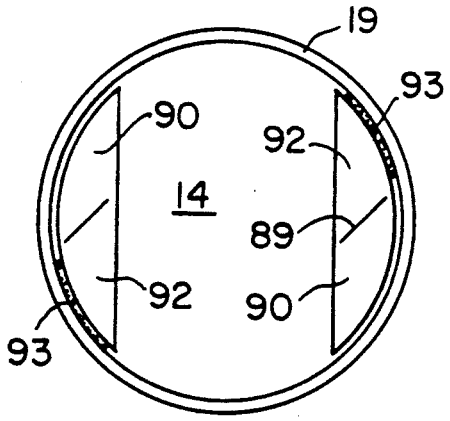
FIG. 34 is a top view of a container with unfolded strips.
Figure 35:
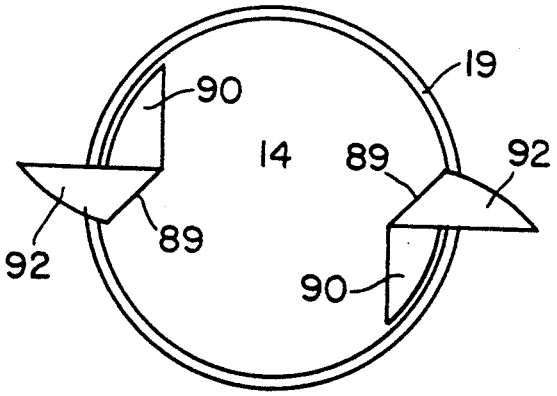
FIG. 35 is a top view of the container of FIG. 34 after the top and strips are severed.
Figure 36:
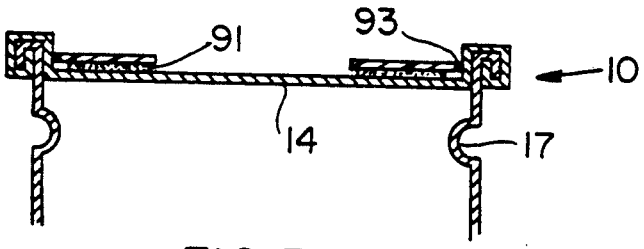
FIG. 36 is a side view of the container of FIG. 34.

FIGS. 34, 35, and 36 show a strip with an angled prestressed hinge section 89 in an unfolded position. The end 90 is adhered to top 14 with adhesive 91 and the other end 92 is adhered to the rim 19 with adhesive 93. When adhesive 93 is severed the strip end 92 folds over the rim 19 to assume the position shown in FIG. 35.

Figure 37:
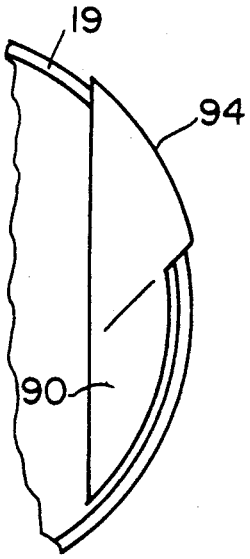
FIG. 37 is a top view of a container having an unfolded strip adhered to a container rim.
Figure 38:
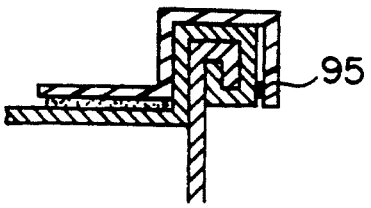
FIG. 38 is a side view of the container of FIG. 37.

FIG. 37 and 38 show an alternate form of this invention with the end 94 secured with an adhesive 95 to the side of the container 12. End sections 90, 92 and 94 may be stiff whereas the prestressed hinge section 89 is elastic or a spring.

It is to be understood that a first end of the strip can be adhered to the top, or when used, the cover. The second end can be free or restrained in any manner, so long as when the top is severed, the prestressing in the strip effects positioning of the strip as described above.

Although it may be more expedient to utilize a curling (prestressed) cover sheet, a non-curling conventional plastic sheet cover may also be used to keep the strips in place. The cover sheet may also be a stretched elastomeric polymer sheet, if desired.

As long as the cover, when used, restrains the strips, it can function satisfactorily even without adhesive attachment of cover to center of can top.

Figure 39:
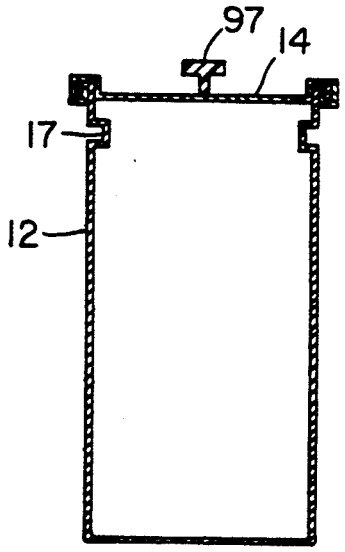
FIG. 39 is a side view of a container having a centrally located tab.
Figure 40:
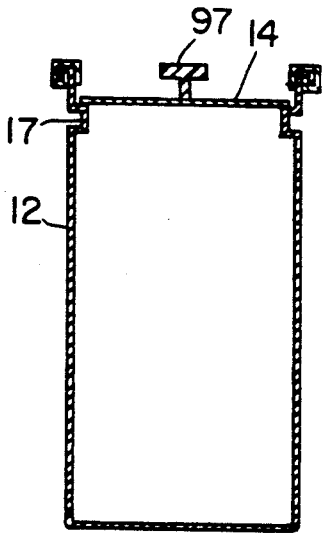
FIG. 40 is a side view of the container of FIG. 39 after the top is severed.

Referring to FIGS. 39 and 40, the container 12 includes a top 14 and an indentation 17. The top includes a handle or tab 97 which need not be prestressed and which can be of any shape so long as it can be grasped. After the top 14 is severed, it rests on indentation 17 and the tab 97 is grasped to remove the top 14 from the container 12.

Figure 41:
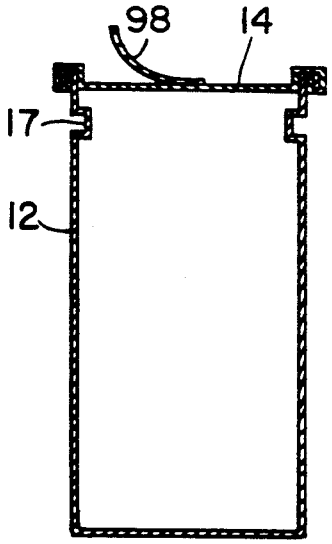
FIG. 41 is a side view of an alternative container having a centrally located tab.
Figure 42:
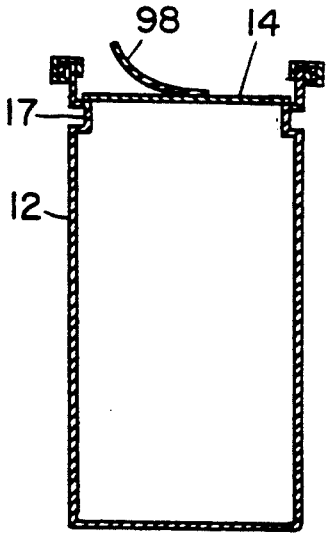
FIG. 42 is a side view of the container of FIG. 41 after the top is severed.

Referring to FIGS. 41 and 42, the container 12 includes a top 14 and an indentation 17. The top includes a strip 98 which need not be prestressed and which can be of any shape so long as it can be grasped. After the top 14 is severed, it rests on indentation 17 and the tab 97 is grasped to remove the top 14 from the container 12.

We claim:

1. A sealed container having a side wall, a peripheral rim and a permanently fixed top free of holes to a body having a volume containing a material, at least one strip means positioned on said top having a first end adhered to said fixed top and the second end adhered either to said sidewall or said rim, said at least one strip having a stress bias such that when said top is severed from said container, one end of said strip becomes positioned away from contact with said top and extends outwardly away from said peripheral rim, and an indentation in said sidewall positioned near said top thereby to prevent said top, when severed from said sidewall from sinking into the material.

2. The container of claim 1 which includes a plurality of said strip means.

3. The container of any one of claims 1 or 2, wherein said strip means comprise a metallic strip.

4. The container of any one of claims 1 or 2, wherein said strip means comprise a polymeric material.

5. The container of any one of claims 1 or 2, wherein said strip means comprises a polymeric filament.

6. The container of any one of claims 1 or 2, wherein said strip means comprises a metallic filament.

7. The container of any one of claims 1 or 2, wherein said strip means comprises a composite material of polymer and non-polymer fibers.

8. The container of any one of claims 1 or 2, wherein said strip means has flat surfaces.

9. A sealed container having a side wall, a peripheral rim and a permanently fixed top free of holes to a body having a volume containing a material, a cover positioned over said fixed top, at least one strip means positioned on said top having a first end adhered to said fixed top or to said cover and the second end adhered either to said rim or said sidewall, said at least one strip having a stress bias such that when said top is severed from said container, one end of said strip becomes positioned away from contact with said top and extends outwardly away from said peripheral rim when severed from said sidewall, and an indentation in said sidewall positioned near said top thereby to prevent said top, when severed from said sidewall from sinking into the material.

10. The container of claim 9 which includes a plurality of said strip means.

11. The container of any one of claims 9 or 10 wherein said strip means comprises a metallic strip.

12. The container of any one of claims 9 or 10 wherein said strip means comprises a polymeric material.

13. The container of any one of claims 9 or 10 wherein said strip means comprises a polymeric filament.

14. The container of any one of claims 9 or 10 wherein said strip means comprises a metallic filament.

15. The container of anyone of claims 9 or 10 wherein said strip means comprises a composite material of polymer and nonpolymer fibers.

16. The container of any one of claims 9 or 10 wherein said strip means has flat surfaces.

17. The container of any one of claims 9 or 10 wherein the severable cover secured near the top periphery of said container encloses the entire top of said container.

18. The container of any one of claims 9 or 10 wherein the severable cover secured near the top-periphery of said container is adhered to the center of the top.

19. The container of claims 9 or 10 wherein the severable cover comprises a polymeric sheet.

20. The container of claims 9 or 10 wherein the severable cover comprises a sheet with a prestressed bias such that when the top and cover are severed the cover end becomes positioned away from said top and extend upwardly away from said top.

21. The sealed container of claims 9 or 10 wherein said cover is comprised of a metallic material.

22. The sealed container of claim 9 or 10 wherein said cover is comprised of a polymeric material.

23. The sealed container of claim 9 or 10 wherein said cover is comprised of a multilayered polymeric material.

24. The sealed container of claim 9 or 10 wherein said cover is comprised of a sheet of composite material of a polymer and non polymer.

* * * * *